US007508121B2

(12) United States Patent
Lykowski

(10) Patent No.: US 7,508,121 B2
(45) Date of Patent: Mar. 24, 2009

(54) SMALL DIAMETER/LONG REACH SPARK PLUG

(75) Inventor: James D. Lykowski, Temperance, MI (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 11/765,060

(22) Filed: Jun. 19, 2007

(65) Prior Publication Data

US 2007/0290596 A1 Dec. 20, 2007

Related U.S. Application Data

(60) Provisional application No. 60/814,818, filed on Jun. 19, 2006.

(51) Int. Cl.
*H01T 13/00* (2006.01)

(52) U.S. Cl. ..... 313/118; 313/141; 313/143

(58) Field of Classification Search ..... 313/118–145; 123/169 R, 169 EI, 32, 41, 310
See application file for complete search history.

(56) References Cited

U.S. PATENT DOCUMENTS

| | | | | |
|---|---|---|---|---|
| 6,160,342 | A | 12/2000 | Nishikawa et al. | |
| 6,191,525 | B1 | 2/2001 | Tanaka et al. | |
| 6,239,052 | B1 | 5/2001 | Fukushima | |
| 6,265,816 | B1 | 7/2001 | Ito et al. | |
| 6,274,971 | B1 | 8/2001 | Sugimoto et al. | |
| 6,310,430 | B1 * | 10/2001 | Moriya | 313/141 |
| 6,334,800 | B1 | 1/2002 | Nishikawa et al. | |
| 6,346,766 | B1 * | 2/2002 | Kanao et al. | 313/141 |
| 6,373,173 | B1 | 4/2002 | Suzuki | |
| 6,407,487 | B1 | 6/2002 | Sugimoto | |
| 6,414,420 | B1 | 7/2002 | Suzuki | |
| 6,559,579 | B2 | 5/2003 | Ito et al. | |
| 6,566,792 | B2 | 5/2003 | Nishikawa | |
| 6,566,793 | B2 | 5/2003 | Honda et al. | |
| 6,590,317 | B2 | 7/2003 | Nishikawa et al. | |
| 6,590,318 | B2 | 7/2003 | Nishikawa et al. | |
| 6,632,381 | B2 | 10/2003 | Sugimoto | |
| 6,680,561 | B2 | 1/2004 | Yamaguchi et al. | |
| 6,724,133 | B2 | 4/2004 | Miyashita et al. | |
| 6,744,188 | B2 | 6/2004 | Nishikawa et al. | |
| 6,744,189 | B2 | 6/2004 | Honda | |
| 6,765,340 | B2 | 7/2004 | Nishikawa et al. | |
| 6,771,009 | B2 | 8/2004 | Nishikawa et al. | |
| 6,822,378 | B2 | 11/2004 | Nishikawa et al. | |
| 6,831,395 | B2 | 12/2004 | Nishikawa | |
| 7,164,225 | B2 | 1/2007 | Yoshimoto et al. | |
| 7,183,702 | B2 | 2/2007 | Kanao et al. | |

* cited by examiner

*Primary Examiner*—Peter J Macchiarolo
*Assistant Examiner*—Donald L Raleigh
(74) *Attorney, Agent, or Firm*—Robert L. Stearns; Dickinson Wright PLLC

(57) ABSTRACT

A spark plug (10) having an elongated ceramic insulator (12) includes numerous design features in various strategic locations. At least the ground electrode (26) is fitted with a rimmed, hemispherical metallic sparking tip (56) which controls rogue electrical arcing (62) and facilitates attachment techniques due to increased surface contact with the ground electrode (26). The various features of the spark plug (10) cooperate with one another so that the physical dimensions of the spark plug (10) can be reduced to meet current demands of newer engines without sacrificing mechanical strength or performance.

12 Claims, 5 Drawing Sheets

FIG - 1
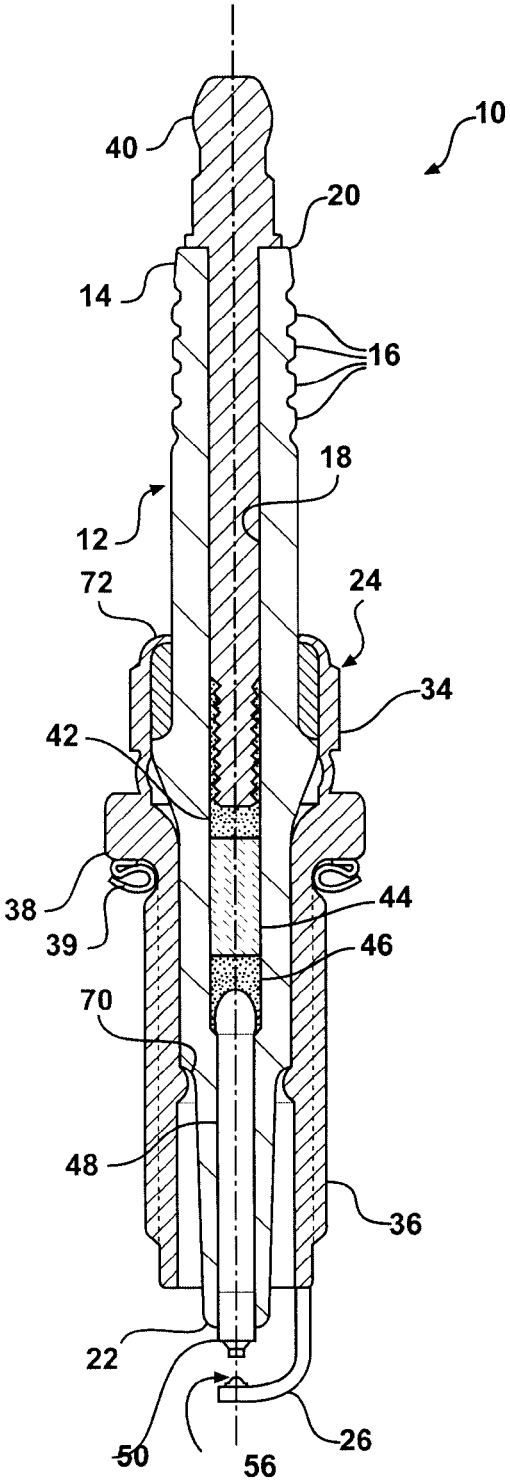
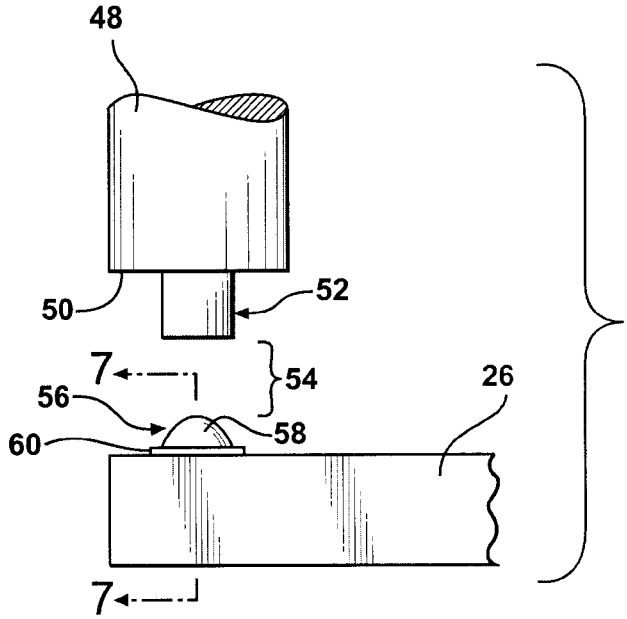
FIG - 2
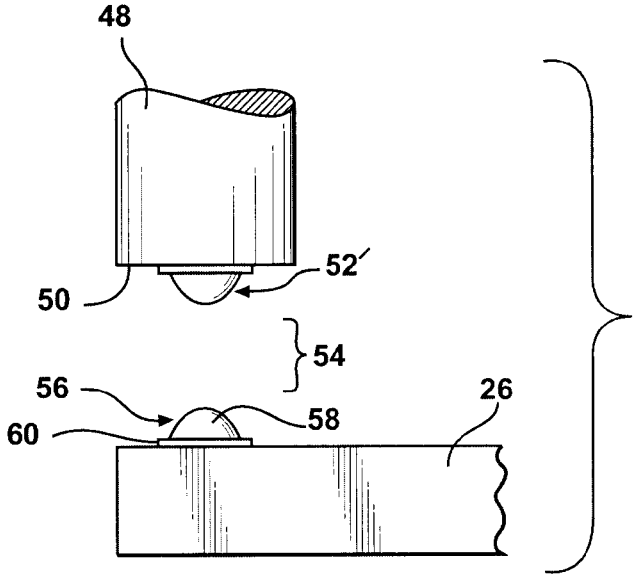
FIG - 3

SMALL DIAMETER/LONG REACH SPARK PLUG

CROSS REFERENCE TO RELATED APPLICATIONS

The present application claims priority to U.S. provisional application entitled 12 mm X-Long Reach Spark Plug having Ser. No. 60/814,818 and filed on Jun. 19, 2006.

BACKGROUND OF THE INVENTION

1. Field of the Invention

The invention relates to a spark plug for an internal combustion engine, furnace, or the like and, more particularly, toward a spark plug having improved mechanical and dielectric strength.

2. Related Art

A spark plug is a device that extends into the combustion chamber of an internal combustion engine, furnace or the like and produces a spark to ignite a mixture of air and fuel. Recent developments in engine technology are driving toward smaller engine displacement. At the same time, intake and exhaust valves are being enlarged for improved efficiency. The physical space reserved for the spark plug is being encroached upon by these changes. Combustion efficiencies are also dictating an increase in voltage requirements for the ignition system. These and other factors are urging the physical dimensions of a spark plug to ever-smaller scales, while demanding greater performance from the spark plug. Current industry demands call for high-performing spark plugs in the 10-12 mm range, with the expectation that these sizes will be further shrunk in the future.

A particular consideration when attempting to downsize a spark plug arises from the diminished dielectric capacity of the ceramic insulator in thin sections. Dielectric strength is generally defined as the maximum electric field which can be applied to the material without causing breakdown or electrical puncture. Thin cross-sections of ceramic insulator can therefore result in dielectric puncture between the charged center electrode and the grounded shell.

Another concern when attempting to downsize a spark plug is diminished mechanical strength resulting from the thinner cross-sections, especially in the ceramic insulator portion. One area in which reduced mechanical strength can be problematic is evidenced in the spark plug manufacturing processes which imposes large axial loads and mechanical stresses on the components. For example, when seating a fired-in suppressor seal inside an insulator and when crimping a shell to the exterior of the insulator, the ceramic material is placed under large stresses and compressive loads. These and other pre-use activities, including the step of installing a spark plug with high torque into a cylinder head, bring the mechanical stresses exerted on a modern spark plug to its yield limits. During use in an engine application, the spark plug is further subjected to mechanical stresses through engine vibration, combustion forces, and thermal gradients. For these reasons, the scaled reduction of a spark plug can push the stress carrying limits of its components to the failure point.

Accordingly, there is a need for an improved spark plug that can address both mechanical and dielectric strength limitations found in current regular, long, and extra-long reach spark plug designs subjected to downsizing efforts.

SUMMARY OF THE INVENTION

A spark plug for a spark-ignited internal combustion engine is provided. The spark plug comprises an elongated ceramic insulator having an upper terminal end, a lower nose end, and a central passage extending longitudinally between the terminal and nose ends. The insulator includes an exterior surface presenting a generally circular large shoulder proximate the terminal end and a generally circular small shoulder proximate the nose end. The large shoulder has a diameter greater than the diameter of the small shoulder. A conductive shell surrounds at least a portion of the insulator. The shell includes at least one ground electrode. A conductive center electrode is disposed in the central passage and has an exposed sparking tip proximate the ground electrode. The lower nose end of the insulator has a maximum outer diameter d(base) measured adjacent the small shoulder and a minimum outer diameter d(tip) measured adjacent the sparking tip of the center electrode. The shell includes an inner bore diameter ID(shell) surrounding the nose end of the insulator, establishing a spatial relationship according to the formula:

$$0.05 \leq \left(\frac{d(\text{base}) + d(\text{tip})}{2}\right) \div ID(\text{shell}) \leq 0.7$$

The applicant has found that a spark plug manufactured according to these dimensional relationships substantially enhances the spark plug performance and is particularly suited for applications in which miniaturized spark plugs must be used in current engine designs due to the competition for space in the combustion area.

BRIEF DESCRIPTION OF THE DRAWINGS

These and other features and advantages of the present invention will become more readily appreciated when considered in connection with the following detailed description and appended drawings, wherein:

FIG. 1 is a cross-sectional view of a spark plug according to the subject invention;

FIG. 2 is an enlarged, fragmentary view of the spark gap region depicting a rimmed, hemispherical metallic sparking tip affixed to the ground electrode;

FIG. 3 is a view as in FIG. 2, but showing an alternative embodiment wherein the center electrode is likewise provided with a convex domed second metallic sparking tip;

DETAILED DESCRIPTION OF THE PREFERRED EMBODIMENT

Figure 4A:
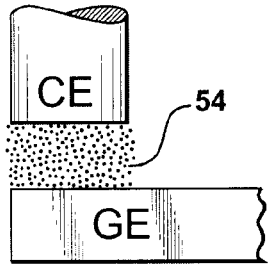
FIG - 4A Prior Art
FIGS. 4A-D depict various prior art spark gap configurations including ground and center electrode features with and without precious metal sparking tip designs.

Referring to the figures, wherein like numerals indicate like or corresponding parts throughout the several views, a spark plug according to the subject invention is generally shown at 10 in FIG. 1. The spark plug 10 includes a tubular ceramic insulator, generally indicated at 12, which is preferably made from aluminum oxide or other suitable material having a specified dielectric strength, high mechanical strength, high thermal conductivity, and excellent resistance to heat shock. The insulator 12 may be molded dry under extreme pressure and then kiln-fired to vitrification at high temperature. The insulator 12 has an outer surface which may include a partially exposed upper mast portion 14 to which a rubber spark plug boot (not shown) surrounds and grips to maintain a connection with the ignition system. The exposed mast portion 14 may include a series of ribs 16 to provide added protection against spark or secondary voltage flashover and to improve grip with the rubber spark plug boot, or may be smooth as in FIG. 9. The insulator 12 is of generally tubular construction, including a central passage 18, extending longitudinally between an upper terminal end 20 and a lower nose end 22. The central passage 18 is of varying cross-sectional area, generally greatest at or adjacent the terminal end 20 and smallest at or adjacent the nose end 22.

An electrically conductive, preferably metallic, shell is generally indicated at 24. The shell 24 surrounds the lower regions of the insulator 12 and includes at least one ground electrode 26. While the ground electrode 26 is depicted in the traditional single L-shaped style, it will be appreciated that multiple ground electrodes of straight or bent configuration can be substituted depending upon the intended application for the spark plug 10.

The shell 24 is generally tubular in its body section and includes an internal lower compression flange 28 adapted to bear in pressing contact against a small lower shoulder 68 of the insulator 12. The shell 24 further includes an upper compression flange 30 which is crimped or formed over during the assembly operation to bear in pressing contact against a large upper shoulder 66 of the insulator 12. A buckle zone 32 collapses under the influence of an overwhelming compressive force during or subsequent to the deformation of the upper compression flange 30 to hold the shell 24 in a fixed position with respect to the insulator 12. Gaskets, cement, or other sealing compounds can be interposed between the insulator 12 and shell 24 to perfect a gas-tight seal and to improve the structural integrity of the assembled spark plug 10.

The shell 24 is provided with a tool receiving hexagon 34 for removal and installation purposes. The hex size complies with industry standards for the related application. Of course, some applications may call for a tool receiving interface other than hexagon, such as is known in racing spark plug applications and in other environments. A threaded section 36 is formed at the lower portion of the metallic shell 24, immediately below a seat 38. The seat 38 may be paired with a gasket 39 to provide a suitable interface against which the spark plug 10 seats in the cylinder head. Alternatively, the seat 38 may be designed with a taper to provide a self-sealing installation in a cylinder head designed for this style of spark plug.

An electrically conductive terminal stud 40 is partially disposed in the central passage 18 of the insulator 12 and extends longitudinally from an exposed top post to a bottom end embedded part way down the central passage 18. The top post connects to an ignition wire (not shown) and receives timed discharges of high voltage electricity required to fire the spark plug 10.

In the example illustrated in FIG. 1, the bottom end of the terminal stud 40 is embedded within a conductive glass seal 42, forming the top layer of a composite suppressor-seal pack. The conductive glass seal 42 functions to seal the bottom end of the terminal stud 40 to a resistor layer 44. This resistor layer 44, which comprises the center layer of the 3-tier suppressor-seal pack, can be made from any suitable composition known to reduce electromagnetic interference ("EMI"). Depending upon the recommended installation and the type of ignition system used, such resistor layers 44 may be designed to function as a more traditional resistor-suppressor or, in the alternative, as an inductive-suppressor. Immediately below the resistor layer 44, another conductive glass seal 46 establishes the bottom or lower layer of the suppressor-seal pack. Accordingly, electricity from the ignition system travels through the bottom end of the terminal stud 40 to the top layer conductive glass seal 42, through the resistor layer 44, and into the lower conductive glass seal layer 46.

A conductive center electrode 48 is partially disposed in the central passage 18 and extends longitudinally from its head encased in the lower glass seal layer 46 to its exposed sparking end 50 proximate the ground electrode 26. The head seats in a necked-down section of the central passage 18. The suppressor-seal pack electrically interconnects the terminal stud 40 and the center electrode 48, while simultaneously sealing the central passage 18 from combustion gas leakage and also suppressing radio frequency noise emissions from the spark plug 10. The suppressor-sealed pack, however, may be substituted with other passive or active features depending upon the requirements of an intended application. As shown, the center electrode 48 is preferably a one-piece structure extending continuously and uninterrupted between its head and its sparking end 50. However, other design arrangements may be used.

A second metallic sparking tip 52 is located at the sparking end 50 of the center electrode 48. (To avoid any confusion, it is noted that a "first" metallic sparking tip will be introduced and described subsequently in connection with the ground electrode 26.) The second metallic sparking tip 52 provides a sparking surface for the emission of electrons across a spark gap 54. The second metallic sparking tip 52 for the center electrode 48 can be made according to any of the known techniques, including the loose piece formation and subsequent detachment of a wire-like or rivet-like construction made from any of the known precious metal or high performance alloys including, but not limited to, platinum, tungsten, rhodium, yttrium, iridium, and alloys thereof. Additional alloying elements may include, but are not limited to, nickel, chromium, iron, carbon, manganese, silicon, copper, aluminum, cobalt, rhenium, and the like. In fact, any material that provides good erosion and corrosion performance in the combustion environment may be suitable for use in the material composition of the second metallic sparking tip 52.

The ground electrode 26 extends from an anchored end adjacent the shell 24 to a distal end adjacent the sparking gap 54. The ground electrode 26 may be of the typical rectangular cross-section, including an iron-based alloy jacket surrounding a copper core.

As perhaps best shown in FIG. 2, a (first) metallic sparking tip, generally indicated at 56, is attached to the distal end of the ground electrode 26, opposing the sparking end 50 of the center electrode 48. I.e., the metallic sparking tip 56 is located directly across the spark gap 54. The metallic sparking tip 56 is intentionally shaped with a rimmed, hemispherical configuration such that it presents a convex dome 58 surrounded by a rim 60. As viewed in profile like in FIG. 2, the shape of the metallic sparking tip 56 can be likened to a fried egg, with the convex dome portion 58 representing the yolk of the analogous egg and the rim portion 60 representing the egg white. Preferably, the rim 60 has a generally annular configuration, although non-annular configurations are also possible. Ideally, although again not necessarily, the convex dome portion 58 and rim 60 are generally aligned with one another along an imaginary central axis intersecting the middle of the spark gap 54.

As with the second metallic sparking tip 52, the (first) metallic sparking tip 56 for the ground electrode 26 can be made according to any of the known techniques, including the loose piece formation into a button-like construction made from any of the known precious metal or high performance alloys including, but not limited to, platinum, tungsten, rhodium, yttrium, iridium, and alloys thereof. Additional alloying elements may include, but are not limited to, nickel, chromium, iron, carbon, manganese, silicon, copper, aluminum, cobalt, rhenium, and alike. In fact, any material that provides good erosion and corrosion performance in the combustion environment may be suitable for use in the material composition of the metallic sparking tip 56.

FIG. 3 represents an alternative embodiment of the invention, wherein the center electrode 48 is fitted with a second metallic sparking tip 52' having a rimmed hemispherical configuration substantially similar to that of the (first) metallic sparking tip 56 attached to the ground electrode 26.

FIGS. 4A-D depict various prior art configurations for the spark gap 54 between ground and center electrodes. In each example of the prior art, the ground electrode is represented by the letters "GE," whereas the center electrode is represented by the letters "CE." FIG. 4A illustrates a typical spark gap 54 configuration, wherein neither the center electrode CE nor ground electrode GE are fitted with metallic sparking tips. In this configuration, electrical potential carried through the center electrode CE arcs through a "zone" of the spark gap 54 to the base material of the ground electrode, which typically comprises a durable, nickel based alloy frequently cored with copper for thermal transmission purposes. In other words, all electrical arcing from the center electrode CE to the ground electrode GE occurs in the spark gap 54.

Figure 4B:
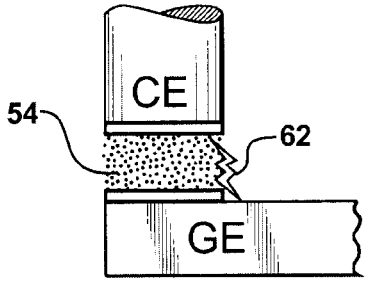
FIG - 4B Prior Art
Figure 4C:
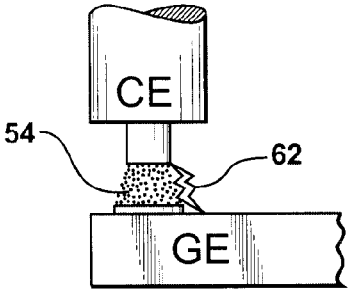
FIG - 4C Prior Art
Figure 4D:
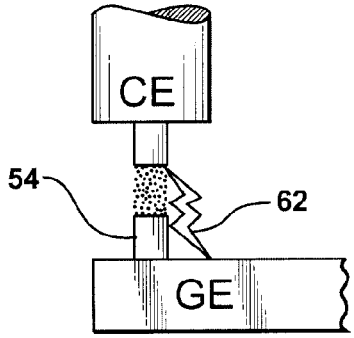
FIG - 4D Prior Art

FIGS. 4B-D represent various prior art configurations where the ground electrode GE is fitted with a metallic sparking tip of either wide or narrow relative construction. An opposing metallic sparking tip on the center electrode CE may be matched or mismatched in terms of its dimensional attributes to the metallic sparking tip on the ground electrode GE. In all of these circumstances, it is common for electrical arcing to overshoot the precious metal pad of the sparking tip and directly land on the base material of the ground electrode GE. This is illustrated by a rogue electrical arc 62. Rogue arcs 62 are common in the combustion environment, and result in inconsistent combustion with a measurable drop in combustion efficiency. As a result of this cycle-to-cycle variation in the ignition event, an automobile driver may feel the engine is running rough and/or its performance is perceived as inconsistent. Accordingly, rogue arcs 62 are highly undesirable.

Figure 5:
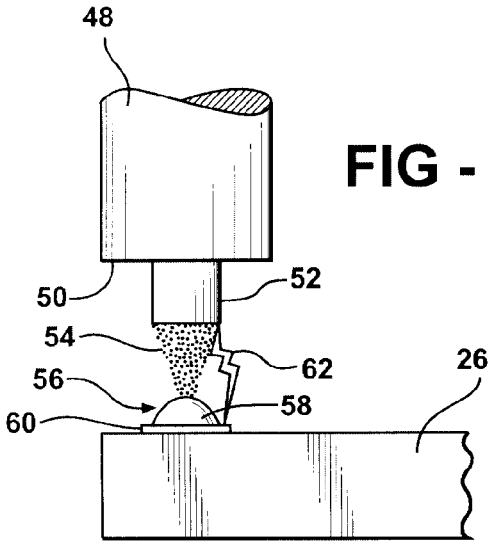
FIG. 5 is a view as in FIG. 2, and illustrating a conical sparking zone extending from the precious metal tip of the center electrode to the rimmed hemispherical metallic sparking tip of the ground electrode.
Figure 6:
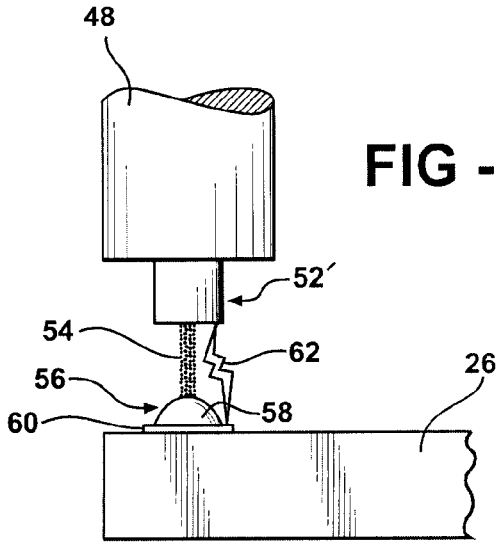
FIG. 6 is a view as in FIG. 3, depicting a generally linear or columnar sparking zone extending between the opposing rimmed hemispherical sparking tips of the center and ground electrodes.

FIGS. 5 and 6 illustrate the rimmed hemispherical metallic sparking tip 56 fitted to the ground electrode 26. Whether the second metallic sparking tip 52 is of the conventional or modified (52') design, it is illustrated in these figures how the hemispherical shape encourages the zone of normal spark arcing in the gap 54 to occur at a more consistent location from cycle-to-cycle as a result of the convex domed geometry. More consistent arc location, is of course desirable because it results in more consistent combustion. Lower cycle-to-cycle variation in the ignition event improves engine smoothness and consistency in performance. Rogue arcs 62 are markedly controlled through the flattened, flange-like rim 60 feature. Due to the corner profile represented by the extended outer periphery of the rim 60, rogue arcs 62 are more readily attracted to the precious metal of the metallic sparking tip 56 with little tendency to overshoot the precious metal pad. Again, this results in more consistent combustion on a cycle-to-cycle basis.

Figure 7:
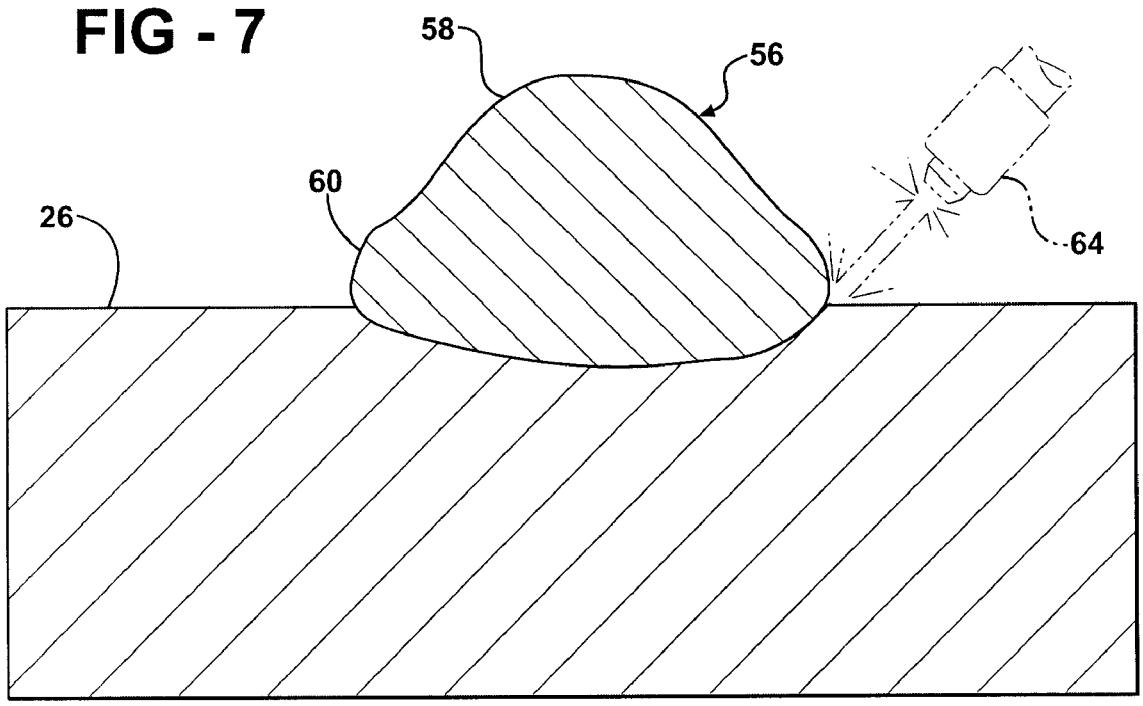
FIG. 7 is an enlarged, realistic cross-sectional view taken generally along lines 7-7 in FIG. 2, with an optional laser welding machine illustratively depicted in phantom.

FIG. 7 is a substantially enlarged cross-sectional view taken along lines 7-7 of FIG. 2, directly through a metallic sparking tip 56 and ground electrode 26. This cross-sectional view illustrates yet another advantage of the rim feature 60. Specifically, the rim 60 creates additional surface area lying in direct contact with the ground electrode 26. As a result, better attachment, or fixation, of the metallic sparking tip 56 can be accomplished. Those of skill will readily envision different methods for attaching the metallic sparking tip 56 to the ground electrode 26. In FIG. 7, the crater-like interface between the bottom of the metallic sparking tip 56 and the upper surface of the ground electrode 26 is suggestive of a resistance welding type operation. Resistance welding is one of many possible techniques which are improved through the increased surface-to-surface contact area between the metallic sparking tip 56 and the ground electrode 26. In phantom, a laser welding device 64 is illustrated. The rim 60 feature has the added benefit of increasing the outer circumferential area of the metallic sparking tip 56, thus in situations where a laser capping operation is carried out, there is a larger welding interface. Similar advantages are realized through the use of high temperature adhesives, mechanical fastening techniques, and the like.

Figure 8:
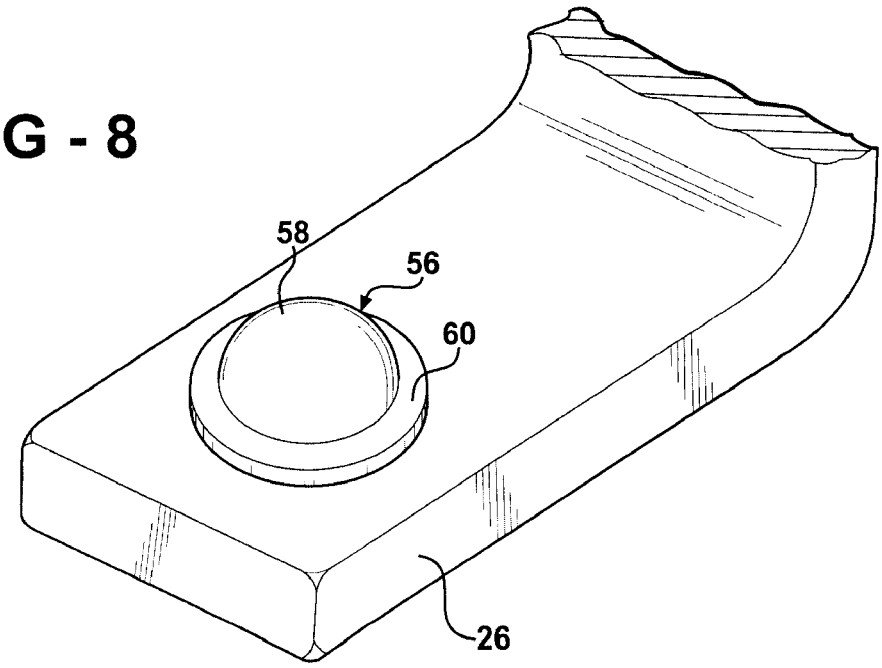
FIG. 8 is a fragmentary perspective view of the ground electrode including a rimmed hemispherical metallic sparking tip according to the invention.

FIG. 8 depicts the metallic sparking tip 56 in perspective form. The unique shape of the metallic sparking tip 56 can be formed in many ways, only a few of the possible ways mentioned here. As one example, a piece of precious metal wire can be severed from a spool, heated and then hot-headed into the characteristic fried egg shape. Alternatively, molten precious metal can be shaped in a rolling operation, casting operation, or in any other satisfactory method.

Numerous structural and geometric configurations of the insulator 12 may be used in the combination set forth herein or independently of one another so as to enhance the mechanical and dielectric characteristics of the resulting spark plug design. In addition to changes in the geometric designs and shapes of the insulator 12, various design changes in the shape of the shell 24, particularly in the lower nose region of the insulator 12, further contribute to the improvements of the subject invention. For example, particular advantage can be identified through the relatively shallow transitional taper angle provided immediately below the large upper shoulder 66 of the insulator 12. This relatively shallow angle reduces the compression stresses and lowers bending moment loads.

Figure 9:
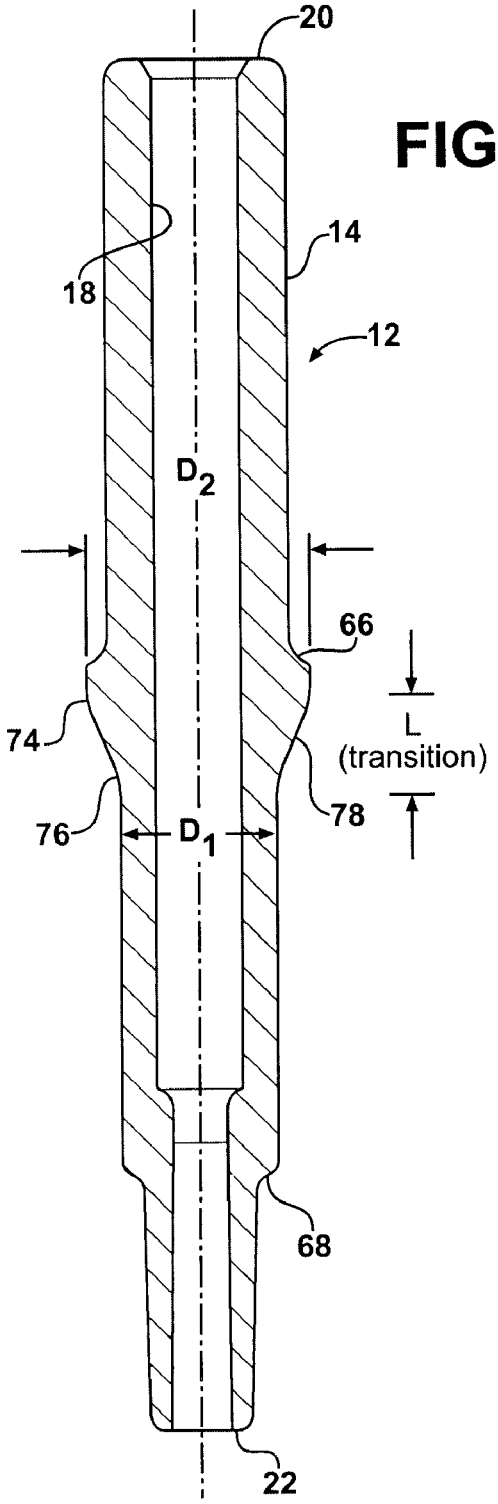
FIG. 9 is a cross-sectional view taken longitudinally through the ceramic insulator of a spark plug according to the subject invention, and identifying various dimensional relationships important to some aspects of the subject invention.
Figure 9A:
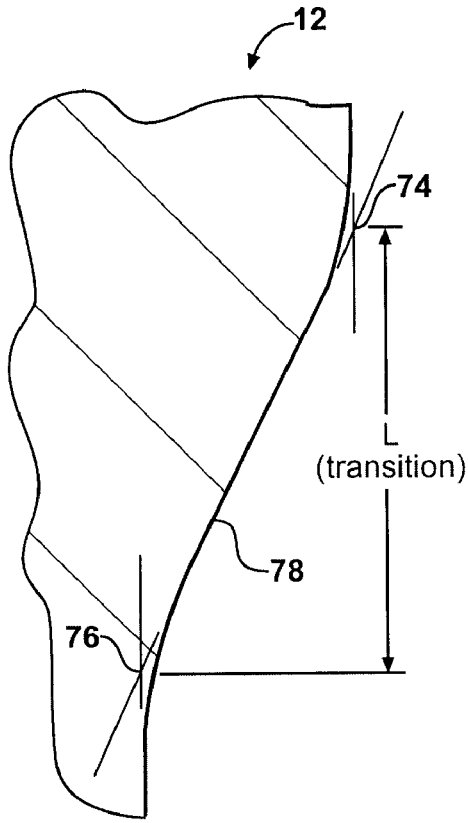
FIG. 9A is an enlarged, fragmentary view of the insulator transition surface highlighting the reference points at which the transition length L(transition) is measured between the rounded and filleted transitions.

FIGS. 9 and 9A depict an especially advantageous geometric configuration for the insulator 12 which enables traditional insulator materials (e.g., ceramics) to be manufactured in small, relatively fragile sizes yet withstand the stresses applied to the insulator during assembly and operation. More specifically, the insulator 12 is shown with its exterior surface presenting a generally circular large upper shoulder 66, proximate the terminal end 20, and a generally circular small shoulder 68, proximate the nose end 22. During assembly in the shell 24, the small shoulder 68 seats against the lower compression flange 28, whereas the large shoulder 66 is pressed by the upper compression flange 30 of the shell 24. A very large compressive force is thus imposed on the insulator 12 in the regions between its large 66 and small 68 shoulders. Mechanically, it becomes very difficult to secure insulator 12 inside of a shell 24 when the size of the spark plug 10 is reduced to fit in small bore or tight fitting engine spaces. For example, spark plugs in the 10-12 millimeter and smaller ranges require the physical dimensions of its insulator 12 to be shrunk to limits where the column strength of the material simply will not support the compression loads which are required to establish and maintain gas-tight seals within the shell 24.

The applicant has discovered a particularly advantageous geometric relationship that enables spark plugs 10 to be reduced in size without exceeding the mechanical strength of standard insulator materials such as ceramics. This is accomplished by manipulating the transition region defined as that portion of the exterior surface of the insulator 12 wherein the physical exterior dimensions of the insulator are reduced from the large shoulder 66 down to the small shoulder 68. Again referring to FIG. 9, the exterior surface of the insulator 12 is shown including a rounded transition 74, and spaced therefrom by a transition length L(transition) a filleted transition 76. The terms "rounded" and "filleted" are borrowed from the well known references in drafting technology "fillets" and "rounds," i.e., interior and exterior corners respectively. As viewed in profile, the rounded transition 74 and filleted transition 76 form something akin to an ogee profile which is necessary to effectively reduce the diameter of the exterior surface of the insulator 12. As shown in FIG. 9, the rounded transition 74 is defined by a major diameter D2 representing the maximum, outer diameter of the insulator 12 adjacent the large shoulder 66. The filleted transition 76, on the other hand, is defined by a minor diameter D1 which represents that portion of the insulator 12 exterior leading toward the small shoulder 68. The transition length L(transition) is a measurement of the longitudinal distance between the rounded 74 and filleted 76 transitions.

FIG. 9A provides an enlarged view of the transition length L(transition), wherein takeoff measurements are located by the theoretical intersection between the transitioning surfaces. A frustaconically sloped transition surface 78 extends between the rounded 74 and filleted 76 transitions. Although a frustaconically tapering geometry is preferred for the transition surface 78, other gently curving profiles may be tolerated without sacrificing the important features of this invention.

A particularly advantageous spatial relationship has been identified which provides the subject insulator 12 with remarkably sturdy mechanical strength so as to withstand the compressive stresses applied to the spark plug 10 during assembly and operation, as well as during handling of the insulator 12 during its formation and firing steps. Specifically, the relationship is established between D1, D2 and the transition length L(transition). Preferably, this relationship is expressed according to the formula:

$$0.5 \le \frac{(D2 - D1)}{L(\text{transition})} \le 3.5$$

While acceptable results can be obtained through products made within this range of geometric relationships, the applicants have found that even more preferred results can be obtained by narrowing the ranges to the following formula:

$$0.55 \le \frac{(D2 - D1)}{L(\text{transition})} \le 1.2$$

For spark plugs manufactured in accordance with vehicular engine applications, the applicant has even defined a most preferred spatial relationship wherein:

$$0.6 \le \frac{(D2 - D1)}{L(\text{transition})} \le 0.8$$

Another improvement is achieved by decreasing the thickness of the nose portion of the insulator 12 so as to increase the air gap between the nose portion and the shell 24. This increased air gap enhances the dielectric capacity, or dielectric strength, of the spark plug 10 in operation because of the high pressure air in this region during the spark event and during initiation of combustion. Furthermore, by reducing the thickness of the nose portion, a reduction or elimination in the tendency for spark tracking and creation of a secondary spark location is realized.

Figure 12:
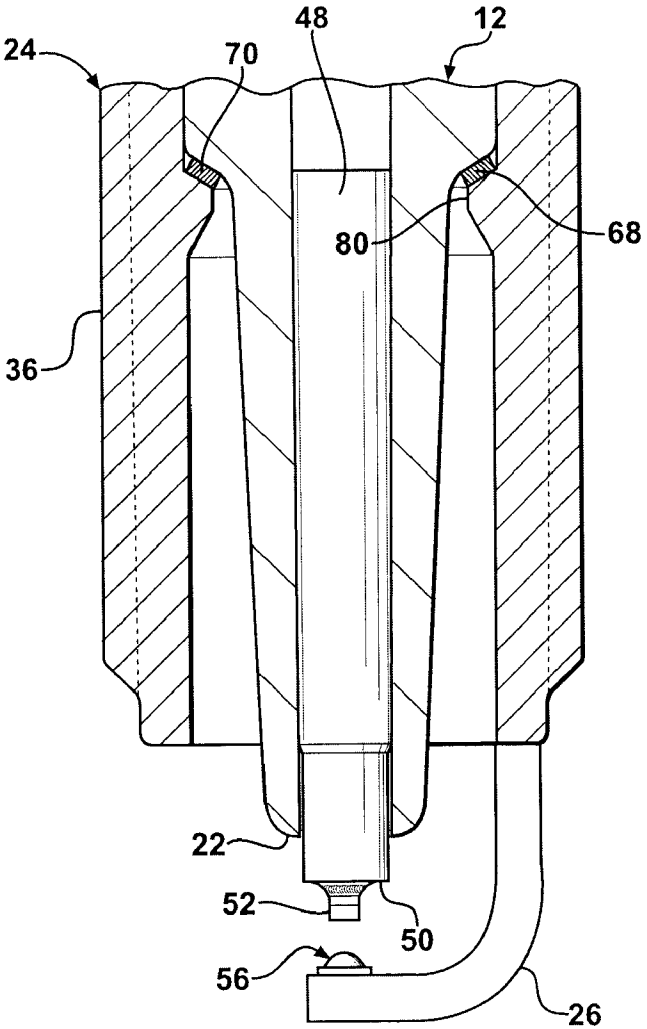
FIG. 12 is an enlarged, fragmentary cross-sectional view of the lower sparking end of the spark plug.
Figure 10:
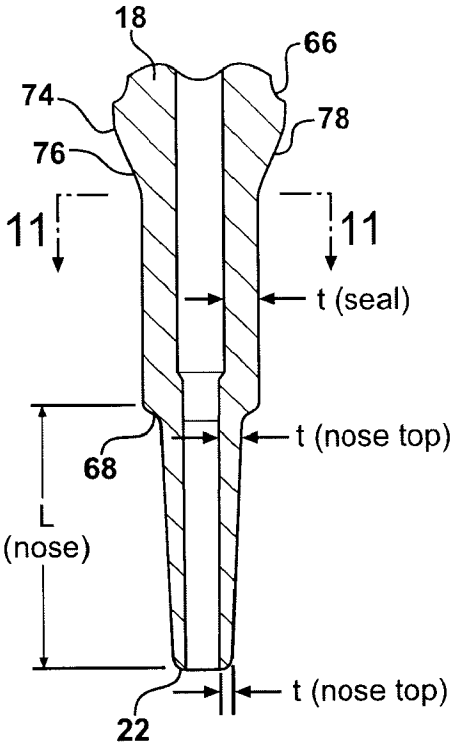
FIG. 10 is a fragmentary cross-sectional view of the lower half of the ceramic insulator, and identifying further dimensional relationships important to some aspects of the subject invention.
Figure 11:
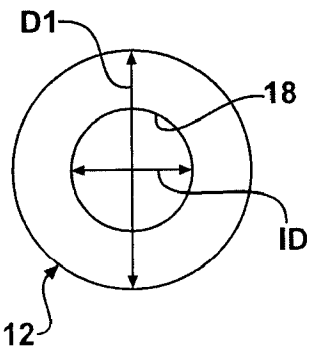
FIG. 11 is a cross-sectional view taken generally along lines 11-11 of FIG. 10.

Further and favorable spatial relationships can be obtained through a reference to FIGS. 10-12. Here, it is illustrated that the nose portion of the insulator 12 has a base diameter d(base) measured immediately below the small shoulder 68. The opposite, or distal end of the nose portion has a smaller outer diameter d(tip). Over the longitudinal length of the nose portion, the wall thickness of the insulator 12 tapers from the larger d(base) measure to the smaller d(tip) measure. It has been found that by carefully controlling the dimensional relationship between the outer diameters in this insulator nose region, relative to the inner diameter of the grounded shell ID(shell), advantages can be achieved in the areas of reduced spark tracking (i.e., surface charges which travel up the insulator nose), and increased space created for high-dielectric combustion gases which limit the tendency for arcing in small diameter spark plugs. More specifically, the applicant has identified the following spatial relationship as providing exceptionally beneficial spark plug performance:

$$0.5 \le \left(\frac{d(\text{base}) + d(\text{tip})}{2}\right) \div ID(\text{shell}) \le 0.7$$

For spark plugs manufactured in accordance with vehicular engine applications, the applicant has even defined a most preferred spatial relationship wherein:

$$0.57 \leq \left(\frac{d(\text{base}) + d(\text{tip})}{2}\right) \div ID(\text{shell}) \leq 0.66$$

Yet another especially advantageous relationship can be achieved by controlling the insulator thickness in the region of the seal t(seal) pack to be as large as possible. This may require reducing the inner diameter 1D(seal) space to provide greater dielectric capacity in this region.

In FIG. 12, the region of the lower compression flange 28 of the shell 24 is depicted in its abutment against the small shoulder 68 of the insulator 12. Here, the lower compression flange 28 has an inner peripheral lip 80. This lip 80 is spaced from the insulator 12 sufficiently so that combustion gases may occupy the space there between, thus enhancing the dielectric properties of the spark plug 10. More specifically, it has been discovered that highly compressed combustion gases can exhibit a dielectric capacity which is greater than that of the ceramic insulator 12. Thus, by enabling combustion gases to occupy this region of the spark plug 10, wherein the grounded shell 24 is closest to the charge center electrode 48, except in the spark gap 54, additional dielectric capacity is highly desirable.

All of the features described herein are important and contribute, collectively, to a spark plug 10 to that can be manufactured in smaller geometric proportions without sacrificing mechanical integrity or sparking performance.

The subject invention as depicted in the accompanying drawings and described above addresses the mechanical and dielectric strength limitations found in the prior art spark plug designs and addresses the issues which arise with respect to demands placed upon spark plugs by newer engine designs. The subject spark plug reduces mechanical stress risers, increases flash-over distance, and reduces electrical stress fields to the elimination of sharp corners throughout the design. Obviously, many modifications and variations of this invention are possible in light of the above teachings. It is, therefore, to be understood that the invention may be practiced otherwise than as specifically described.

What is claimed is:

1. A spark plug for a spark-ignited combustion event, said spark plug comprising:

an elongated ceramic insulator having an upper terminal end, a lower nose end, and a central passage extending longitudinally between said terminal and nose ends;

said insulator including an exterior surface presenting a generally circular large shoulder proximate said terminal end and a generally circular small shoulder proximate said nose end, said large shoulder having a diameter greater than the diameter of said small shoulder;

a conductive shell surrounding at least a portion of said insulator, said shell including at least one ground electrode;

a conductive center electrode disposed in said central passage and having an exposed sparking tip proximate said ground electrode;

said insulator having a nose region extending from said nose end, said nose region having a maximum outer diameter d(base) measured adjacent said small shoulder and a minimum outer diameter d(tip) measured adjacent said sparking tip of said center electrode; and said shell including an inner bore diameter ID (shell) surrounding said nose region of said insulator, and wherein a spatial relationship is established according to the formula:

$$0.05 \leq \left(\frac{d(\text{base}) + d(\text{tip})}{2}\right) \div ID(\text{shell}) \leq 0.7$$

said insulator including a rounded transition and a filleted transition, said rounded transition spaced from said filleted transition by a transition length (L), both said rounded and filleted transitions located longitudinally between the disparate diameters of said large and small shoulders, said rounded transition having a major diameter D2 and said filleted transition having a minor diameter D1, and wherein a spatial relationship is established according to the formula:

$$0.5 \leq \frac{(D2 - D1)}{L(\text{transition})} \leq 3.5.$$

2. The spark plug of claim 1 further including a metallic sparking tip attached to said distal end of said ground electrode, said sparking tip having a convex dome and a rim surrounding said dome, said rim disposed in surface-to-surface contact with said ground electrode.

3. The spark plug of claim 2 wherein said rim of said metallic sparking tip has a generally annular configuration.

4. The spark plug of claim 3 wherein said dome and said rim are generally aligned with one another along an imaginary central axis.

5. The spark plug of claim 4 wherein said shell includes upper and lower compression flanges bearing in pressing contact with said respective large and small shoulders of said insulator to place said insulator in compression between said large and small shoulders.

6. The spark plug of claim 5 wherein said lower compression flange of said shell includes an inner peripheral lip, said lip being spaced from said lower nose end of said insulator such that combustion gases may occupy the space and enhance the dielectric properties therein.

7. A spark plug for a spark-ignited combustion event, said spark plug comprising:

an elongated ceramic insulator having an upper terminal end, a lower nose end, and a central passage extending longitudinally between said terminal and nose ends;

said insulator including an exterior surface presenting a generally circular large shoulder proximate said terminal end and a generally circular small shoulder proximate said nose end, said large shoulder having a diameter greater than the diameter of said small shoulder;

a conductive shell surrounding at least a portion of said insulator, said shell including at least one ground electrode;

a conductive center electrode disposed in said central passage and having an exposed sparking tip proximate said ground electrode;

said insulator having a nose region extending from said nose end, said nose region having a maximum outer diameter d(base) measured adjacent said small shoulder and a minimum outer diameter d(tip) measured adjacent said sparking tip of said center electrode; and said shell including an inner bore diameter ID (shell) surrounding said nose region of said insulator, and wherein a spatial relationship is established according to the formula:

$$0.057 \leq \left(\frac{d(\text{base}) + d(\text{tip})}{2}\right) \div ID(\text{shell}) \leq 0.66$$

said insulator including a rounded transition and a filleted transition, said rounded transition spaced from said filleted transition by a transition length (L), both said rounded and filleted transitions located longitudinally between the disparate diameters of said large and small shoulders, said rounded transition having a major diameter D2 and said filleted transition having a minor diameter D1, and wherein a spatial relationship is established according to the formula:

$$0.5 \leq \frac{(D2 - D1)}{L(\text{transition})} \leq 3.5.$$

8. The spark plug of claim 7 further including a metallic sparking tip attached to said distal end of said ground electrode, said sparking tip having a convex dome and a rim surrounding said dome, said rim disposed in surface-to-surface contact with said ground electrode.

9. The spark plug of claim 8 wherein said rim of said metallic sparking tip has a generally annular configuration.

10. The spark plug of claim 7 wherein said dome and said rim are generally aligned with one another along an imaginary central axis.

11. The spark plug of claim 7 wherein said shell includes upper and lower compression flanges bearing in pressing contact with said respective large and small shoulders of said insulator to place said insulator in compression between said large and small shoulders.

12. The spark plug of claim 7 wherein said lower compression flange of said shell includes an inner peripheral lip, said lip being spaced from said lower nose end of said insulator such that combustion gases may occupy the space and enhance the dielectric properties therein.

* * * * *